United States Patent [19]

Kelly

[11] Patent Number: 4,642,950

[45] Date of Patent: Feb. 17, 1987

[54] REROOFING WITH SLOPING PLATEAU FORMING INSULATION

[76] Inventor: Thomas L. Kelly, 50 Randolph Ave., Waterbury, Conn. 06710

[21] Appl. No.: 247,287

[22] Filed: Mar. 25, 1981

Related U.S. Application Data

[63] Continuation of Ser. No. 21,152, Mar. 16, 1979, abandoned.

[51] Int. Cl.[4] ..... E04B 7/02

[52] U.S. Cl. ..... 52/90; 52/309.8; 52/408

[58] Field of Search ..... 52/90, 309.8, 408, 409

[56] References Cited

U.S. PATENT DOCUMENTS

| | | | |
|---|---|---|---|
| 3,045,293 | 7/1962 | Potchen | 52/309.8 |
| 3,511,008 | 5/1970 | Grems et al. | 52/309.8 |

FOREIGN PATENT DOCUMENTS

| | | | |
|---|---|---|---|
| 1509131 | 3/1969 | Fed. Rep. of Germany | 52/90 |
| 2301655 | 9/1976 | France | 52/90 |

*Primary Examiner*—Carl D. Friedman

*Attorney, Agent, or Firm*—Hayes & Reinsmith

[57] ABSTRACT

An arrangement and system is provided for creating a sloping roof out of a flat roof and also of providing said sloping roof with slopes which merge into plateaus.

This roof has been so designed that it consists of a plurality of insulation blocks or sheets, some of which may be tapered and some of which may be provided with plane surfaces and the uppermost elements of the courses of insulation sheets are of laminated construction consisting of a styropore block which may be either tapered or of plane configuration, and these blocks are of laminate construction with a substantially ½" fiberboard. As is well-known in this art, the usual insulation block or sheet may be formed of styrofoam which will not accept an adhesive, and the heat from hot tar or the like which may be used in the construction of roofs may cause the styrofoam insulation sheets to disintegrate. Styropore blocks will not be affected by the heat generated by hot tar applications to the roof. It is also a fact that the use of styropore insulation sheets, instead of styrofoam insulation sheets, results in tremendous economies. An adhesive has been developed which will be accepted by styropore and because of this I am enabled to use the styropore elements to which the laminate of fiberboard is adhesively secured. The invention also involves a novel arrangement whereby a filler is provided in order to stagger the loose underlaid sheets which one skilled in this art will appreciate the advantages of this arrangement.

6 Claims, 12 Drawing Figures

REROOFING WITH SLOPING PLATEAU FORMING INSULATION

This is a continuation of application Ser. No. 21,152, filed Mar. 16, 1979, abandoned.

BRIEF SUMMARY OF THE INVENTION

This invention relates generally to the creation of sloping roofs which may also provide plateaus between the slopes of existing flat roof structures. It comprises a relatively economical and non-complex system of so changing roofs that they provide this tapering and plateau forming construction. In many instances where buildings are being restored or the appearance thereof is being altered it is desirable to provide means whereby this form of roof may be created on an existing roof. In accomplishing my purpose I provide on the existing flat roof structure a plurality of insulation sheets or blocks which are preferably formed of styropore and certain of which are of tapered form while others are of flat planar form. Styropore will be understood to be an insulation material composed of a multiplicity of minute spheres of expanded polystyrene pressed together. The upper course of these insulation blocks is preferably formed of laminated construction and each block is composed of a strata of preferably ½" thick fiberboard which is caused to adhere to a styropore block or sheet. The remaining lower courses of the built-up roof structure comprise a plurality of loose preferably 1" thick blocks of styropore and do not include the fiberboard lamination. In certain courses or layers of insulation sheets or blocks fillers are used between blocks so as to stagger the next adjacent course of insulation blocks. The advantages of this construction will be readily apparent.

The use of styropore in this construction results in substantial economies and functions as well, if not better, than styrofoam or other conventional insulating means. With the discovery of an adhesive which will be accepted by styropore the basic principles involved in this invention makes their use practical in the creation of a sloping roof out of a normally flat roof. Aside from the aforementioned substantial economies which are realized by styropore instead of conventional styrofoam is that the styrofoam blocks which are often used for insulation purposes are substantially affected by the heat generated by hot tar which may be applied to the roof. When this is done it has been found that styrofoam insulation blocks disintegrate while the styropore insulation blocks are not so affected.

In order to facilitate the construction of such sloping roof having plateaus between slopes the taper on certain of the styropore blocks, as will hereinafter be explained, has been standardized to provide a taper from 0 to 1" in 4 feet. It will be clear that this standardization produces economies in construction time.

It is considered to be of significance that this system of providing a sloping roof provides an arrangement whereby the roof may come off of a slope or taper into an elongated plateau. As far as I am aware this constitutes a novel and ingenious roof, including the means for such construction.

The entire system with which I am concerned involves four basic units, one unit comprising ½" fiberboard insulation which may be cut into any desired cubic foot pattern such as 2×2, 4×4, 2×8 and 4×8. The second basic composite of this system consists of a ½" fiberboard caused to adhere to a styropore block forming a laminated block and this block is cut into a taper pattern from 0 to 1" in four feet. The third basic unit which is used in this system consists of the ½" fiberboard laminated to a 1" styropore sheet it being cut into the equivalent cubic feet but with no taper. The fourth composite of this basic structure comprises a standard filler of 1" styropore which is cut into the desired cubic foot pattern but is not a laminated component. In certain adaptations of the roof a fifth unit may be used and in this instance a 45° angle is cut in any of the basic four units discussed above, and these 45° angle cuttings would be cut for a right- and a lefthand use.

This particular construction which will be explained in detail hereinafter may produce a peaked roof or it may be formed to slope upwardly to any point desired.

Additional objects and advantages of the present invention will become more readily apparent to those skilled in this art when the following general statements and description are considered.

DETAILED DESCRIPTION

Figure 1A:
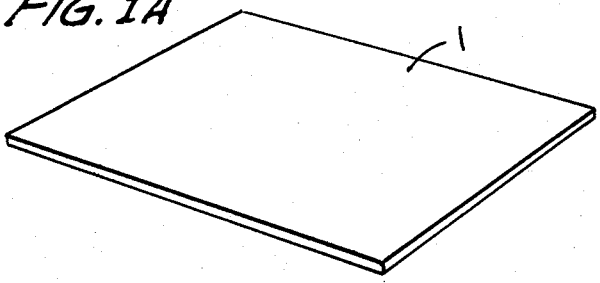
FIG. 1A is a perspective view of the approximately ½" thick fiberboard.
Figure 1B:
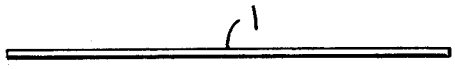
FIG. 1B is an elevational view of the fiberboard illustrated in FIG. 1A.

In the accompanying drawings and particularly in FIGS. 1 through 5 I have illustrated a plurality of elements which are so combined and put together in order to form the tapering plateau roof insulation structure of this invention. I have designated the fiberboard sheet by the numeral 1 and each of these fiberboard sheets is of approximately ½" thickness and are adapted to be adhesively secured to either a tapered or plane styropore insulation block to provide tapered sections which merge into plateau or flat sections. In FIGS. 2A and 2B of the drawings is disclosed a tapered insulation block 3 preferably providing a taper from 0 to 1" in 4 feet. The tapered insulation blocks are preferably, though not necessarily, of a 4 foot dimension from the tip of the taper 5 to the highest point 7 of the insulation block. The fiberboard 1 is dimensionally substantially equal to the dimensions of the tapered block 3 and the fiberboard element which is caused to adhere to the insulation block 3 to provide a laminated structure such as generally illustrated and designated by the letter L in FIG. 2B. An adhesive has been developed which styropore will accept so that it is now possible to provide the laminated element of L wherein the base or tapered block 3 is formed of styropore. As will become apparent as this description proceeds the laminated tapered insulation blocks L are only used to provide the top course of a roof structure which provides the tapered and flat sections as desired by this invention. In FIGS. 3A and 3B a perfectly flat or plane block of insulation 9 is illustrated and this block as in the case with the tapered blocks is formed of the desirable styropore. A fiberboard lamination is of substantially the same dimensions as the flat block 9 is adhesively secured to one surface of the block 9 to provide a laminated element designated generally by the letter P in FIG. 3B of the drawings. Again, the laminated blocks P are only used in the top course of the tapered and plateau forming roof construction. It will become clear hereinafter that the laminated elements P are used in the top course between the laminated elements L.

Figure 2A:
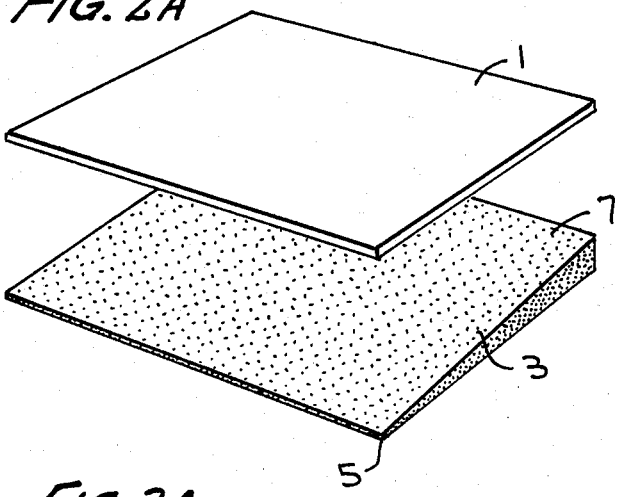
FIG. 2A is an exploded perspective view of the fiberboard of FIG. 1A in position to be adhesively attached to a tapered insulation block formed of styropore.
Figure 2B:
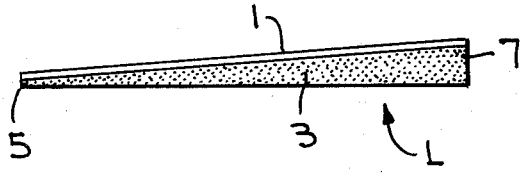
FIG. 2B is an end elevational view of the tapered block of FIG. 2A to which has been adhesively secured the fiberboard to produce a laminated structure.
Figure 4B:
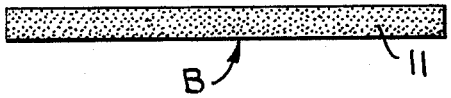
FIG. 4B is an elevational view of the styropore block of FIG. 4A.
Figure 4A:
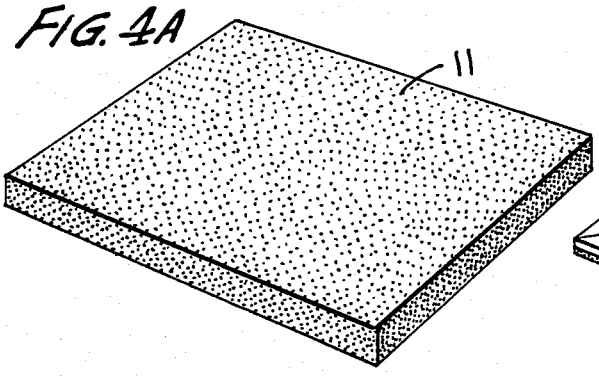
FIG. 4A is a perspective view of a plane or flat block of styropore without the fiberboard lamination.

In FIGS. 4A and 4B a flat, plane styropore insulation block 11 is illustrated and as will be apparent from these two views of the drawings these blocks are not laminated and are utilized in this roof construction in courses below the top course of the construction. This planar, not-laminated block 11 is designated in its entirety by the letter B. The lamination in FIG. 5 of the drawings is designated generally by the numeral 13 and consists of a tapered block L as is illustrated in FIG. 2B. The particular block 13 is mitered as at 12 so as to form in effect two blocks 14 and 16 which are cut at a 45° angle and this particular block is adaptable for use in a roof construction such as that illustrated in FIG. 7 of the drawings. In the detailed discussion to follow it will be apparent that this cutting or mitering provides a lefthand and a righthand block being cut at the necessary angle.

Figure 6:
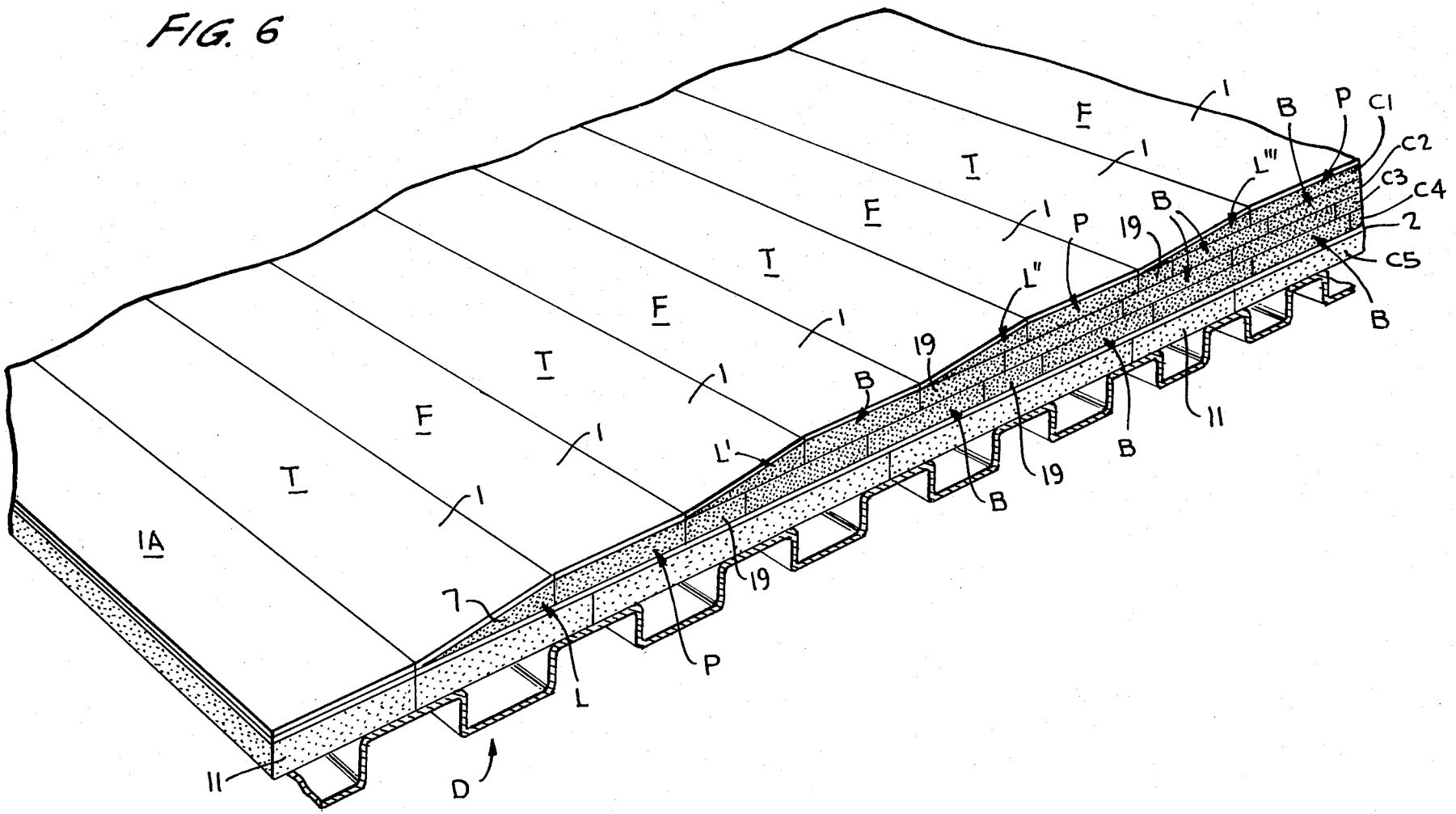
FIG. 6 is a perspective view in section, with parts thereof broken away, illustrating the several courses which are employed to produce the desired roof providing tapered sections merging into flat or plateau sections.

In FIG. 6 of the drawings a complete roof assembly is illustrated disclosing the construction wherein a tapered roof is provided which due to this ingenious construction produces a plurality of preferably alternating tapered and plateau sections. As has been pointed out, in many reconstruction installations it is desirable to produce a roof which is tapered and also which has the desired plateau sections. In FIG. 6 I have disclosed any suitable type of roof deck which is designated in its entirety by the letter D and this is preferably, though not necessarily, an old deck upon which is built up the structure of this invention to provide the desired features. As will become clearly evident as this description proceeds the tapered and plateau construction is achieved by a system which involves the particular placing or positioning of a plurality of different shapes and types of insulation blocks.

Figure 3A:
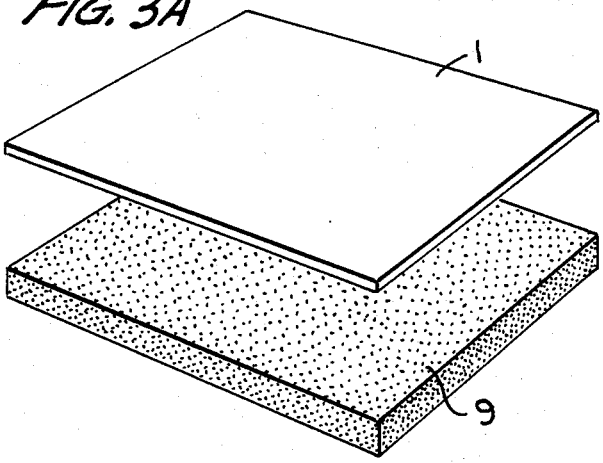
FIG. 3A is an exploded view in perspective of a strip of fiberboard in position ready to be adhesively secured to a plane or flat block of styropore.
Figure 3B:
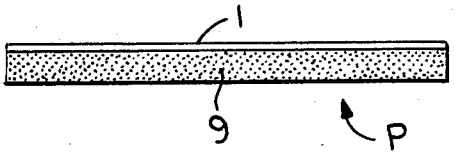
FIG. 3B is an elevational view illustrating the styropore block and the fiberboard sheet of FIG. 3A adhesively secured together forming a laminated element.

The lower course, which I have designated C5 is formed of a plurality of abutting insulation blocks forming the existing roof insulation, upon which is laid the existing roof membrane 2. The next course, which I have designated C4, is composed of an initial tapered styropore block 7 (FIG. 6) to which a sheet of fiberboard 1 is caused to adhere to provide a laminated element L (see FIG. 2B). It is now to be understood that the laminated element L, which is the first or forwardmost element of course C4 provides the lower or forward edge of the insulated roof and provides a tapered section T on the upper part of the roof. It is preferable that a sheet of fiberboard designated as 1A is laid on the top of the membrane 2 overlying the end or forwardmost block of insulation of the series of blocks involved in the course C5. The fiberboard 1A is preferably adhesively secured to the membrane 2 overlying the block of the series of blocks used in the course of blocks C5. Adjacent to the higher end 7 of the tapered laminated block L is positioned laminated block P as illustrated in FIG. 3B of the drawings. This laminated block P is composed of a sheet of fiberboard 1 which is adhesively secured to the block and since the laminated block of insulation P is a planar or flat block a plateau or flat section F is provided on the roof.

Rearwardly adjacent to the just described block P is what I shall term a filler block 19 which is formed of styropore and is preferably of less width than the block P. It will be hereinafter made clear that a plurality of filler blocks 19 are used in the various courses of insulation blocks which form the tapered and flat sections of the roof, and such filler blocks 19 function to stagger the courses of blocks so that a juncture between adjacent blocks is not in vertical alignment with a juncture of the next lower or upper courses of blocks. The remaining insulation blocks of the course C4 are flat not-tapered blocks as particularly disclosed at B in FIG. 4B of the drawings.

A laminated tapered insulation block L′ is provided and in this instance is laid on the forwardmost filler block 19 and the next rearwardly adjacent block B, and this laminated tapered block L′ provides a tapered section T on the roof and is rearwardly adjacent to the forward flat section F. The laminated tapered insulation block L′ forms the forward block of the course of blocks C3. The rearwardly remaining blocks B of course C3 are the flat plane blocks illustrated in FIG. 4B. It is to be noted that another filler block 19 is disposed in the course C3 between certain of the blocks B of this course.

A further laminated insulation block L″ is laid on the structure rearwardly of the forwardmost insulation block B of the course of blocks C3. This laminated tapered insulation block provides a tapered section T on the roof. Rearwardly adjacent to the tapered laminated insulation block L″ is laid a flat plane insulation block P to provide a flat or plateau section F to the roof. Rearwardly adjacent to the forwardmost block P of the course of blocks C2 is disposed a filler block 19 and it is to be understood that the laminated tapered block L″ composes the forwardmost block of the course of blocks C2. The rearward blocks of the course C2 are designated by the letter B and are of the structure of the insulation block illustrated in FIG. 4B. A further tapered laminated insulation block L‴ is provided to provide a tapered section T. This tapered laminated insulation block L‴ constitutes the forwardmost block of the course of blocks C1 and I lay a laminated insulation block P rearwardly of the tapered laminated block L‴ to provide a further flat or plateau section F.

As illustrated in FIG. 6 a roof following the concept of this invention provides a plurality of tapered and flat upper sections which are designated respectively by the letters T and F. It is to be understood that all of the tapered insulation blocks L of this invention are laminated and appear only in the top courses of the structure and produce the tapered upper sections T. All of the insulation blocks P which are of laminated construction appear solely on the uppermost courses of the roofing construction and provide the flat sections F on the roof. Thus, it will be apparent that the fiberboard laminations 1 on both the tapered and flat plane blocks are on the top of the roofing structure and are adapted to receive thereover any suitable and conventional roofing material. It will further be apparent that filler blocks 19 are provided at proper positions in each of the courses of insulation blocks in order to stagger the junctures between the blocks in adjacent courses.

If a peaked roof construction is being formed the system illustrated in FIG. 6 would be followed to provide the other slope of the roof.

Figure 5:
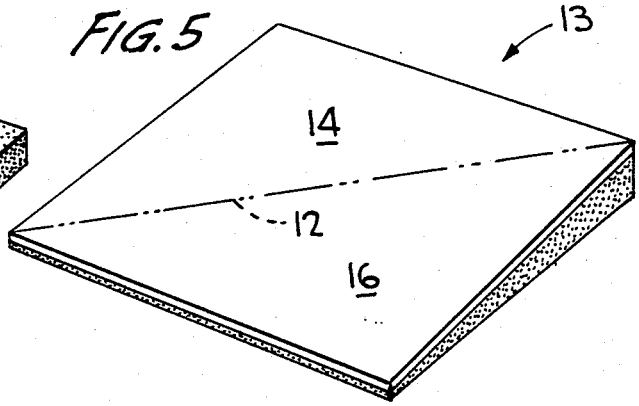
FIG. 5 is a perspective view of the block illustrated in FIG. 2B which has been cut at a 45° angle to provide a righthand block and a lefthand block.
Figure 7:
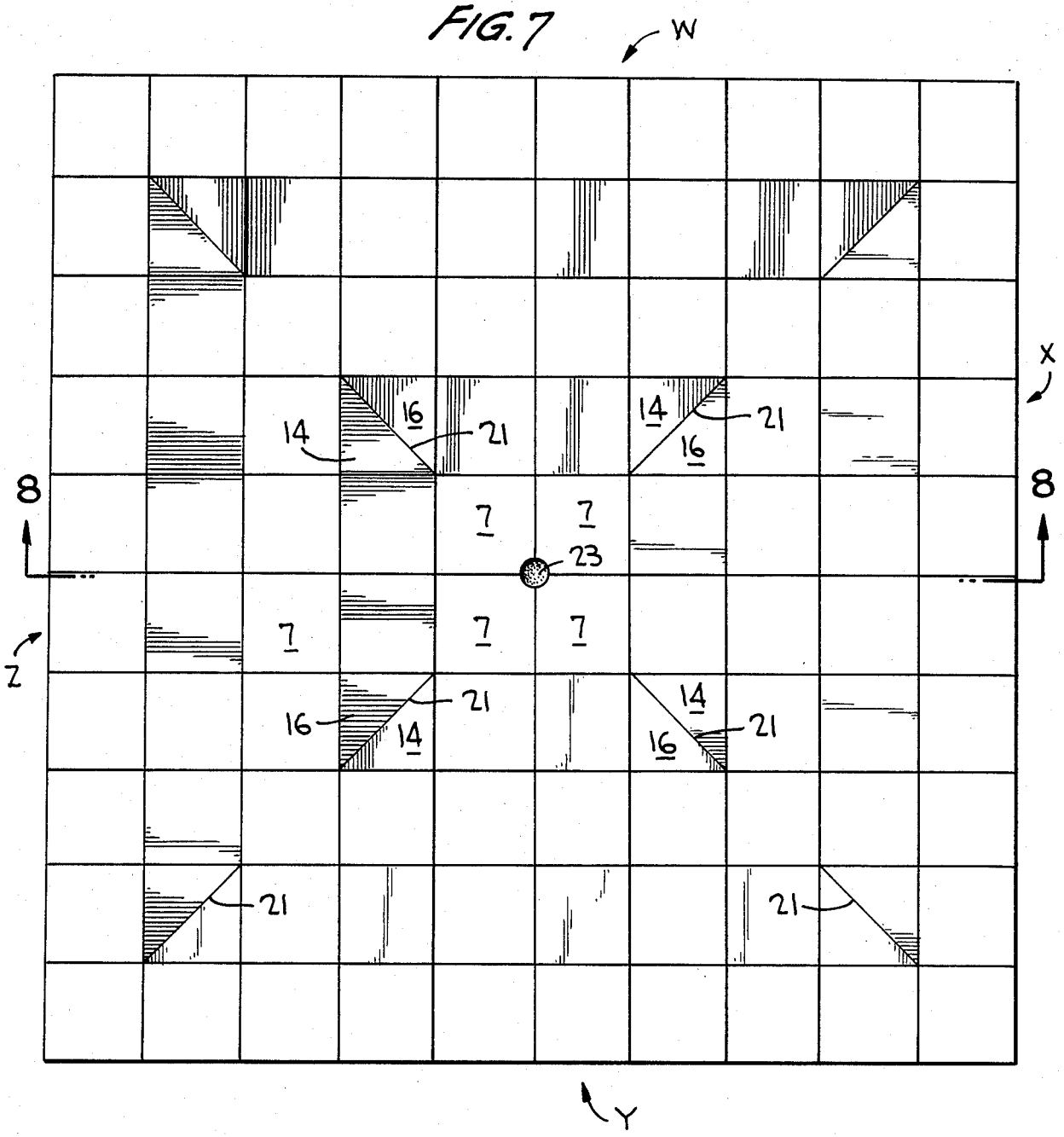
FIG. 7 is a plan view of a roof utilizing the blocks illustrated in FIG. 5 of the drawings.
Figure 8:
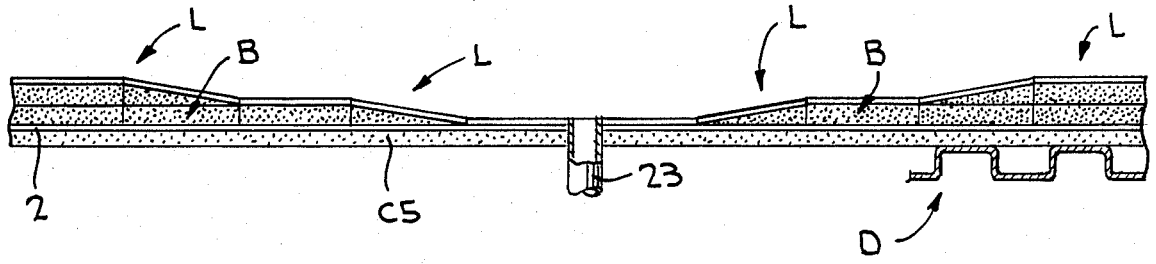
FIG. 8 is a view taken on the line 8—8 of FIG. 7.

In FIGS. 5, 7 and 8 a somewhat modified arrangement is disclosed, and as one example from among many, I have illustrated in FIG. 7 such a construction wherein different sections of roof are disclosed and wherein as will be explained block 13 of FIG. 5 is used at the juncture of the various sections. In this example I have used the letter W to designate in its entirety one section of the roof, the letter X to designate in its entirety a further section of the roof, the letter Y to designate in its entirety a further section of the roof, and the letter Z to designate in its entirety another section of the roof. This roof comprising the sections W, X, Y and Z presents the similar tapered and flat sections of the roof illustrated particularly in FIG. 6 of the drawings and in FIG. 7 and 8 I have used the same reference characters as heretofore used to designate similar parts. The sections of roof, W, X, Y and Z, meet together and the blocks 13 which are mitered as particularly illustrated in FIG. 5 to provide in effect two blocks 14 and 16 which mate together along the line of diagonal cut 21 so that the parts 14 and 16 will mate together.

In the example shown the block 16 comprises the lefthand block and the block 14 comprises the righthand block. In the center of these roof sections a drain 23 may be provided.

What is claimed is:

1. For use in roofing applications having different design specifications with variable overall roof height and variable area coverage and requiring positive water drainage, a sloping plateau insulation system for a roof with alternately disposed flat and tapered modular insulation units, the insulation system comprising a level deck, a plurality of courses of insulation blocks of rectangular cross-section supported on the deck, the plurality of courses being in overlying relation to one another, the rectangular blocks of each course being disposed in edge-to-edge abutment to adjacent blocks of its respective course, the rectangular blocks being of uniform height to provide a flat level surface for each course contained in a common plane, the rectangular blocks of each course including an end block, the end blocks of adjacent courses being in stepped offset relation to one another, the courses collectively forming built-up insulation sections of varying height, and a plurality of insulation blocks of generally triangular cross-section, each triangular insulation block being in abutment with the rectangular end block of its respective course, the triangular insulation blocks each being of uniform size and having a maximum height corresponding to the height of the rectangular blocks, the triangular insulation blocks each being dimensioned and configured to provide a uniformly tapered configuration with a sloping surface in merging relation with adjacent flat surfaces of adjacent courses, whereby the insulation system in cross-section provides alternating flat and tapered surfaces.

2. The system of claim 1 wherein the insulation blocks are formed of expanded polystyrene.

3. The system of claim 2 wherein fiberboard is adhesively secured to an upper surface of each insulation block.

4. The system of claim 1 wherein each course includes rectangular insulation blocks of a predetermined size relative to the size of the blocks of adjacent courses to stagger the junctures between abutting edges of blocks of each course in offset relation to junctures between abutting edges of blocks of adjacent courses.

5. The system of claim 1 further including a layer of insulation means mounted on the deck providing a flat surface on which the lowermost course of insulation blocks is supported.

6. A modified system of alternately disposed flat and tapered modular insulation units and comprising a level roof deck, a first course of flat insulation blocks disposed in abutting positions and supported on the roof deck, the first course including an end block, additional courses of insulation blocks overlying one another in a stepped fashion starting from said end block of said first course, each of said additional courses respectively having a triangular insulation block of tapered configuration and an adjacent rectangular end block, the triangular insulation block of each additional course providing a surface which is tapered to merge with the flat surface of the underlying course and the rectangular adjacent end block of its respective course to provide alternate sloped and flat surface sections for a roof in a stepped fashion.

* * * * *